US007575141B1

(12) United States Patent
Liang et al.

(10) Patent No.: US 7,575,141 B1
(45) Date of Patent: Aug. 18, 2009

(54) ACTUATOR FOR ELECTRICAL NAIL GUN

(75) Inventors: Chia-Sheng Liang, Taipei Hsien (TW); Chu Hsiang Tseng, Taipei Hsien (TW)

(73) Assignee: De Poan Pneumatic Corp., Taipei (TW)

( * ) Notice: Subject to any disclaimer, the term of this patent is extended or adjusted under 35 U.S.C. 154(b) by 82 days.

(21) Appl. No.: 12/025,081

(22) Filed: Feb. 4, 2008

(51) Int. Cl.
*B25C 5/15* (2006.01)

(52) U.S. Cl. ..... 227/131; 227/8; 227/133; 173/124; 173/205

(58) Field of Classification Search ..... 227/131, 227/129, 132, 2, 120, 8, 133; 173/205, 122, 173/124, 178
See application file for complete search history.

(56) References Cited

U.S. PATENT DOCUMENTS

| | | | | |
|---|---|---|---|---|
| 4,121,745 | A * | 10/1978 | Smith et al. | 227/8 |
| 4,129,240 | A * | 12/1978 | Geist | 227/8 |
| 4,204,622 | A * | 5/1980 | Smith et al. | 227/7 |
| 5,320,270 | A * | 6/1994 | Crutcher | 227/131 |
| 5,511,715 | A * | 4/1996 | Crutcher et al. | 227/131 |
| 5,720,423 | A * | 2/1998 | Kondo et al. | 227/130 |
| 6,053,293 | A * | 4/2000 | Sato et al. | 192/35 |
| 6,607,111 | B2 | 8/2003 | Garvis et al. | |
| 6,669,072 | B2 | 12/2003 | Burke et al. | |
| 6,796,475 | B2 * | 9/2004 | Adams | 227/2 |
| 6,971,567 | B1 * | 12/2005 | Cannaliato et al. | 227/2 |
| 7,121,443 | B2 * | 10/2006 | Sun et al. | 227/131 |
| 7,201,303 | B2 * | 4/2007 | Leimbach | 227/131 |
| 7,325,711 | B2 * | 2/2008 | Schiestl et al. | 227/131 |
| 7,334,715 | B2 * | 2/2008 | Oda et al. | 227/2 |
| 2005/0218177 | A1 | 10/2005 | Berry et al. | |

FOREIGN PATENT DOCUMENTS

| | | | |
|---|---|---|---|
| EP | 1582300 | A2 | 10/2005 |
| WO | 2005097428 | A2 | 10/2005 |

* cited by examiner

*Primary Examiner*—Scott A. Smith

(57) ABSTRACT

An actuator is arranged in a housing of an electrical nail gun. The actuator includes a sliding base, an external-running brushless direct current motor, a swing base and an electric driver. The sliding base is slidably disposed on an end of a located supporter which is positioned in the housing. The sliding base loads a spring and forms a hitting nail bar thereon. The motor has a stator and a rotator attached on an outer wall of the stator. A flywheel is driven by the motor and is configured to engage or disengage with/from the sliding base. The swing base is pivotally mounted on the housing. The swing base is adjacent to the sliding base and the supporter. The motor is installed in the swing base. The electric driver is attached to the housing and is adjacent to an end side of the swing base. The electric driver has a rod member driven by electricity. The rod member drives the swing base to swing to a first position where the flywheel meshes with the sliding base to thereby drive the sliding base to move downwards, and a second position where the flywheel disengages from the sliding base to thereby cause the sliding base to reposit. It is advantage to simplify the configuration of the actuator for the flywheel and is useful for the miniaturization of the electrical nail gun.

10 Claims, 8 Drawing Sheets

ACTUATOR FOR ELECTRICAL NAIL GUN

BACKGROUND

The present invention relates to an electrical nail gun with a kinetic energy clutch mechanism, and more particularly to an actuator which is arranged in the kinetic energy clutch mechanism for providing kinetic energy.

An electrical nail gun is a type of tool used to hit nails into wood or some other kind of material. Usually, there is a battery pack or an AC electrical power source in a housing of the electrical nail gun to provide electrical power to a motor, thereby rotating the motor. A rotary kinetic energy of the motor is transformed into a linear kinetic energy by a transmission mechanism to drive a hitting nail bar to hit nails.

Among a more advanced technology, many U.S. patents, such as U.S. Pat. No. 6,607,111 and U.S. Pat. No. 6,669,072 and so on, teach a flywheel driven by a DC motor via a conveyor belt or an engagement of gears, and a clutch assembly being capable of linear movement by traction of a wire disposed on an axis of a solenoid. The clutch assembly has a wire drum and connects to a driving base via at least a wire. When a nail gun is driven by a user, the clutch assembly is moved along an axis direction to mesh with a flywheel which is rotating, thereby rotating the clutch assembly. Therefore, a rotary kinetic energy is transformed into a linear kinetic energy of the hitting nail bar to then impact nails via traction of the wire. However, the structure of the DC motor, the flywheel, and the belt or the gears are complicated, and it is a disadvantage to miniaturize the electrical nail gun and improve the service life of the nail gun.

In addition, a number of patents, such as US Patent 20050218177, WO No. 2005097428, and EP No. 1582300 and so on, teach a linear movement produced by a solenoid is used to push a swing arm with a roller to swing. A driving base of a hitting nail bar is pushed by the roller to urge the driving base to mesh with a rotating flywheel. Thus, a rotary kinetic energy of the flywheel is transformed into a linear kinetic energy of a hitting nail bar to impact a nail. Wherein, the roller, the driving base, and the flywheel cooperatively form a clutch assembly being capable of engagement or disengagement. However, the disadvantage consists in the actuator of the flywheel. The flywheel is driven to rotate by the motor via a conveyer belt or an engagement of the gears. This actuator component of the belt or the gears is complicated, and needs to be improved.

BRIEF SUMMARY

To overcome the problems as the prior art described above, what is needed, therefore, is to provide an actuator which is arranged in the kinetic energy clutch mechanism of an electrical nail gun, and without using belt, gear or the like, for simplifying the complicated configuration of the actuator.

An object and effect of the present invention is carried out through the following technology means. An actuator is arranged in a housing of an electrical nail gun. The actuator includes a sliding base, an external-running brushless direct current motor, a swing base and an electric driver. The sliding base is slidably disposed on an end of a located supporter which is positioned in the housing. The sliding base loads a spring and forms a hitting nail bar thereon. The motor has a stator and a rotator attached on an outer wall of the stator. A flywheel is driven by the motor and is configured to engage or disengage with/from the sliding base. The swing base is pivotally mounted on the housing. The swing base is adjacent to the sliding base and the supporter. The motor is installed in the swing base. The electric driver is attached to the housing and is adjacent to an end side of the swing base. The electric driver has a rod member driven by electricity. The rod member drives the swing base to swing to a first position where the flywheel meshes with the sliding base to thereby drive the sliding base to move downwards, and a second position where the flywheel disengages from the sliding base to thereby cause the sliding base to reposit.

According to the present invention, a flywheel is mounted to the outer wall of the motor, and therefore the flywheel is directly driven by the motor. The complicated construction of the actuator is simplified. Thus, it is useful for the miniaturization of the electrical nail gun, and it is an advantage to improve service life and stability of the electrical nail gun.

In addition, the present invention further includes that the sliding base is fixedly mounted on a sliding plate, the sliding plate is slidably attached to a guiding pole which is positioned in the housing, and a compressible spring is wrapped around the guiding pole for pushing the sliding plate as the spring is compressed. The stator of the motor has a shaft which is disposed on the swing base, the rotator has a sleeve barrel which is attached around the shaft, and the flywheel is mounted to an outer side of the sleeve barrel. A side surface of the sliding base defines a plurality of linear grooves therein, and the flywheel defines a plurality of ring-shaped or sector-shaped grooves therein for mesh with the linear grooves of the sliding base. The swing base is rotatably mounted on a post axis in the housing, and the flywheel is adjacent to end sides of the sliding base and the supporter. The swing base is formed to have an arm portion thereon. The electric driver is a solenoid valve. An extension plate extends out from the swing base, and the rod member pushes the extension plate to thereby drive the swing base to swing from the second position to the first position. An elastic member is disposed between the extension plate and an end wall of the housing for driving the swing base to swing from the first position to the second position.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
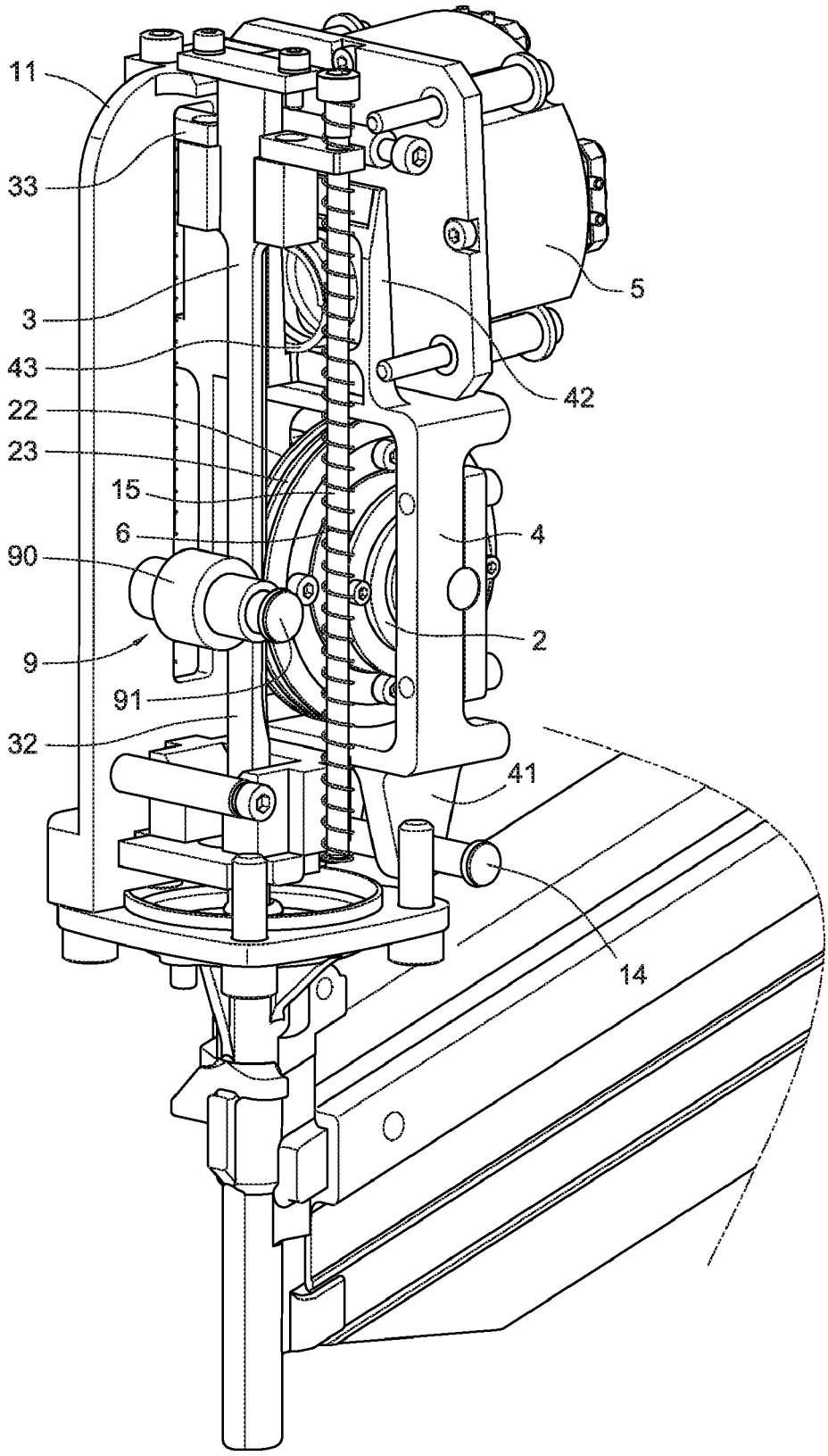
FIG. 1 is an isometric view of an external-running direct current motor, which is arranged in a kinetic energy clutch mechanism in accordance with a preferred embodiment of the present invention.
Figure 2:
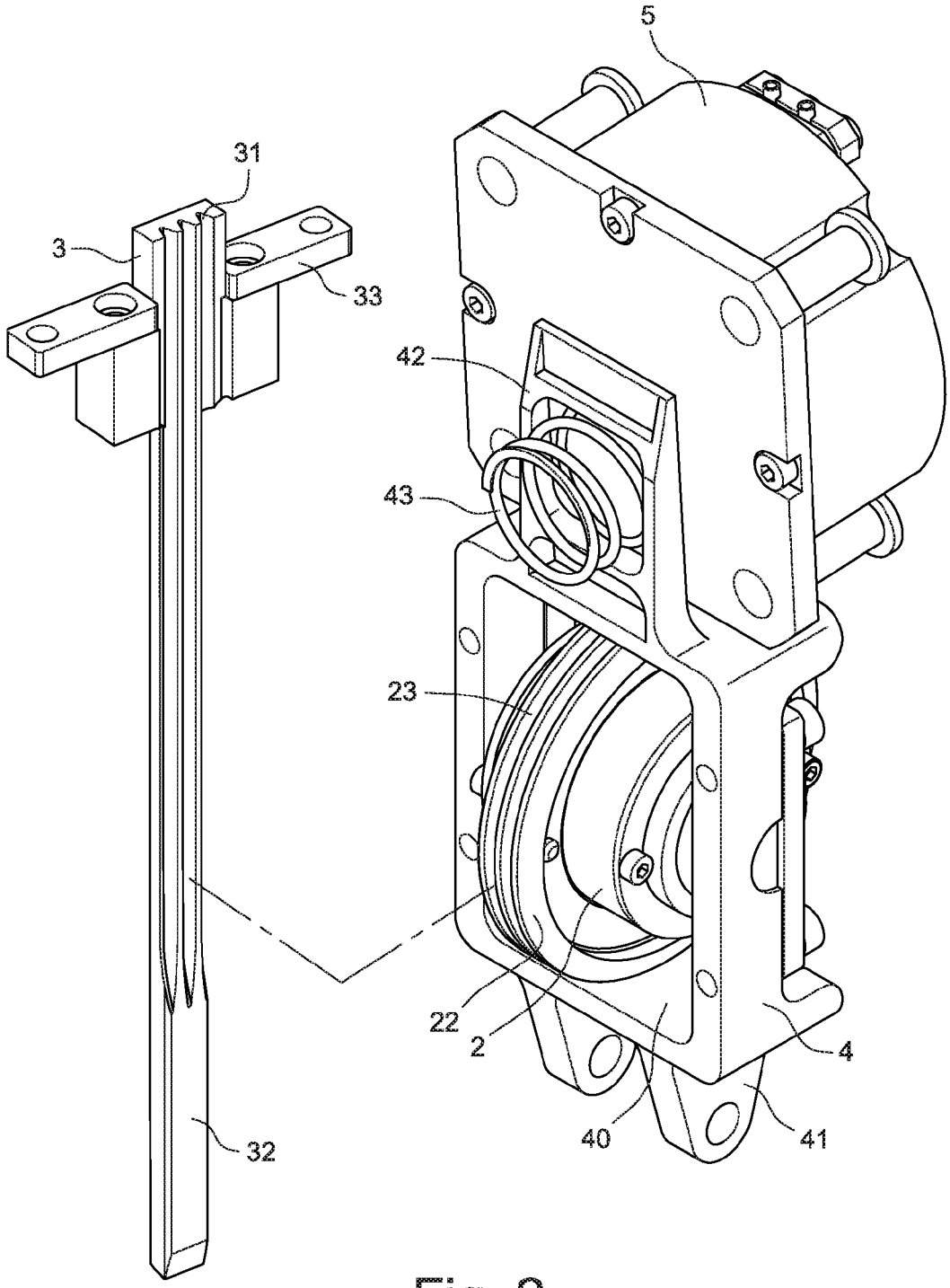
FIG. 2 is an isometric and schematic view of the motor, a swing base and sliding base in accordance with a preferred embodiment of the present invention.
Figure 3:
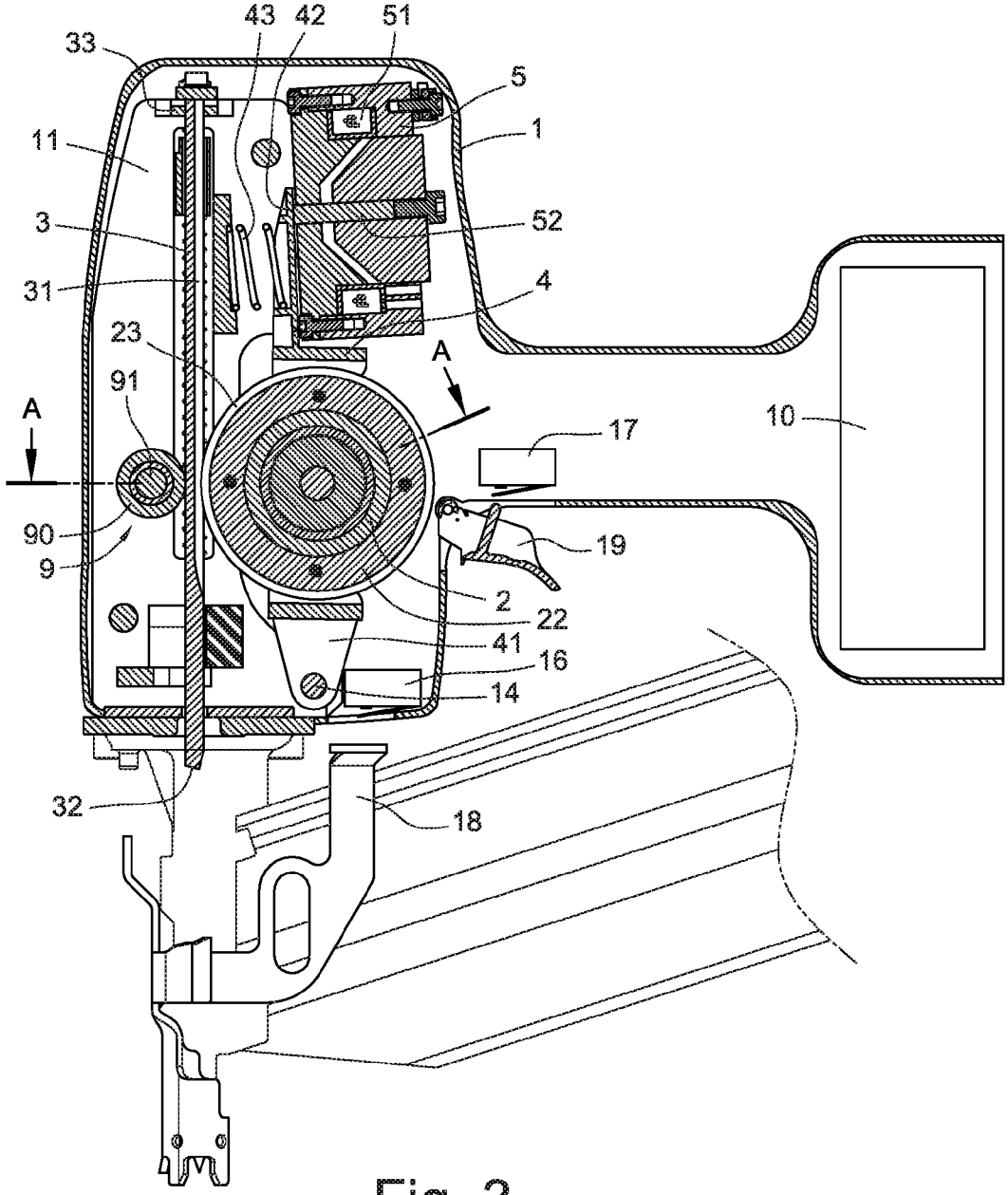
FIG. 3 is a cross-sectional view of the preferred embodiment of the invention, showing the motor positioned in the clutch mechanism.

Referring to FIG. 1 and FIG. 2, a clutch mechanism for transmission of kinetic energy in an electrical nail gun in accordance with a preferred embodiment of the present invention is shown. Referring also to FIG. 3, a cross-sectional view of an actuator of the electrical nail gun in accordance with a preferred embodiment of the present invention is shown. A housing 1 of the electrical nail gun has a battery pack 10 arranged in a distal end thereof for providing DC (direct current) power source. A supporting bracket 11 is formed on a head portion of the housing 1 for mounting a sliding base 3, a swing base 4 and an electric driver 5 thereon. An external-running DC brushless motor 2 is attached to the swing base 4. A first switch 16 and a second switch 17 are arranged in the housing 1. The first switch 16 is located on a bottom end of the housing 1 where a safety sliding rod 18 is capable of touching the first switch 16. The second switch 17 is located on an end side of the housing 1 where a trigger 19 mounted on the housing 1 can touch the second switch 17.

Figure 5:
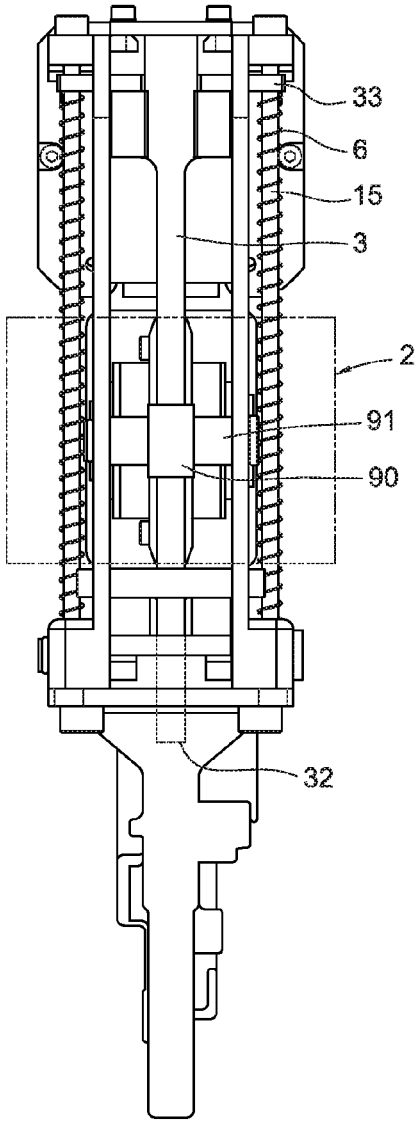
FIG. 5 is a schematic view of the sliding base in accordance with a preferred embodiment of the present invention.
Figure 6:
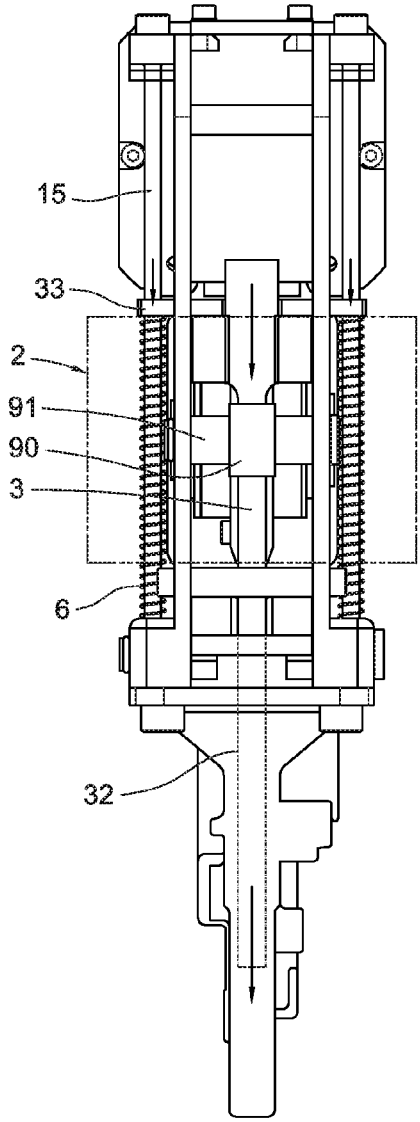
FIG. 6 is similar to FIG. 5, but showing the sliding base in working status.

The sliding base 3, loading a spring 6, is slidably mounted in the housing 1 and arranged on an end side of a located supporter 9. Substantially, the sliding base 3 is mounted to a sliding plate 33. The sliding plate 33 is slidably arranged on at least one guiding pole 15 (as shown in FIG. 5). A compressible spring 6 is wrapped around the guiding pole 15 for pushing the sliding plate 33 to move upwards as the spring 6 is compressed. The sliding base 3 is positioned in an upper position by the driven force of the compressible spring 6. The supporter 9 is a roller 90 in the present embodiment of the invention. The roller 90 is pivotally attached to the supporting bracket 11 via a shaft 91 and pivots about the shaft 91. The sliding base 3 defines a plurality of linear grooves 31 therein. A hitting nail bar 32 is fixedly mounted on a bottom end of the sliding base 3.

Figure 4:
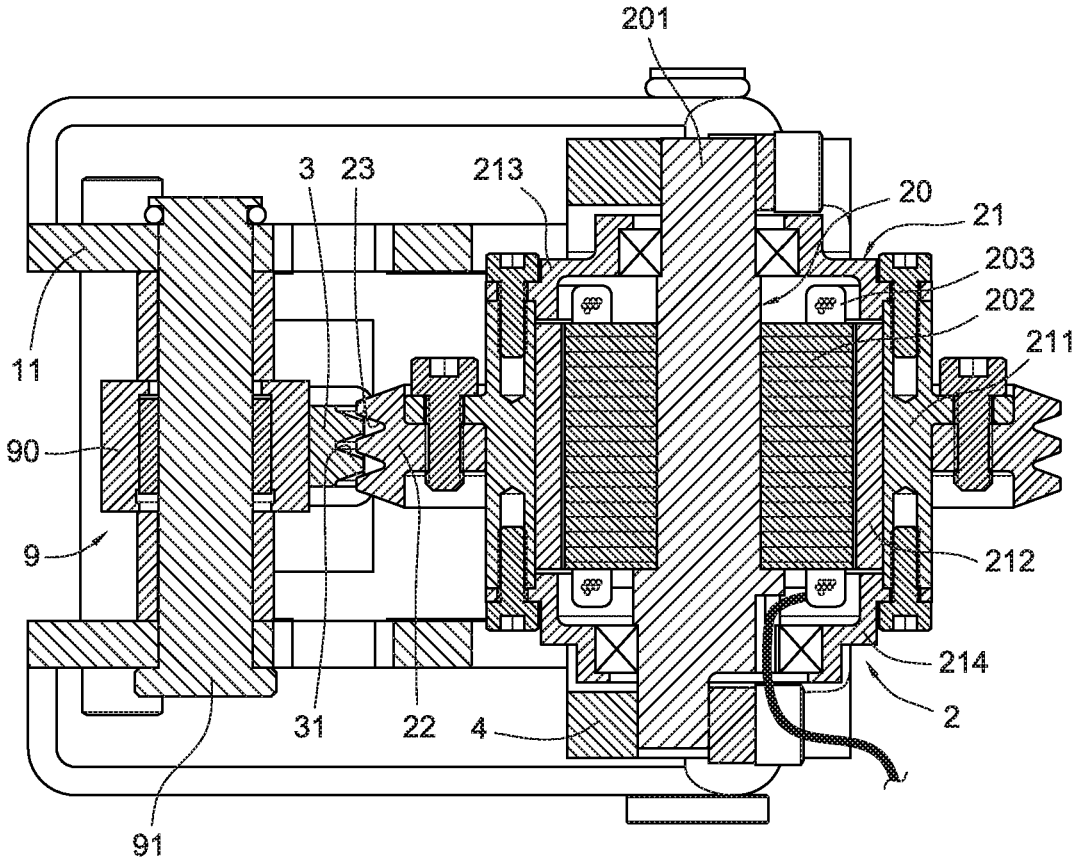
FIG. 4 is a cross-sectional view of FIG. 3, taken along a line A-A.

The motor 2 can be driven by the startup of the battery pack 10. Substantially, the battery 10 is controlled by the first switch 16 or the second switch 17. Alternatively, the motor 2 may be driven by other AC (Alternating Current) power supplies via a rectifier and a conductive wire. The motor 2 has a stator 20 (as shown in FIG. 4) and a rotator 21 which is set around an outer wall of the stator 20. The stator 20 has a shaft 201 disposed on the swing base 4. The shaft 201 has a plurality of silicon steel sheets 202 attached thereon and an solenoid coil 203 wrapped thereon. The rotator 21 has a sleeve barrel 211 which is disposed on top of the shaft 201, the silicon steel 202 and the solenoid coil 203, and two supporting cover 213, 214 arranged on two sides thereof. A magnet 212 is mounted on an inner wall of the sleeve barrel 211. A flywheel 22 is mounted on an outer wall of the sleeve barrel 211. The flywheel 22 defines a plurality of ring-shaped (sector-shaped) grooves 23 therein for meshing with the linear grooves 31 of the sliding base 3. When the solenoid coil 203 of the stator 20 is activated by electricity, the sleeve barrel 211 of the rotator 21 with the flywheel 22 is driven to rotate.

The swing base 4 defines a receiving room therein for accommodating the motor 2. A shape of the swing base 4 may be similar to a shape of the motor 2. An opening 40 is defined in an outside wall of the swing base 4 for partial exposure the ring-shaped (or sector-shaped) groove 23 outside the swing base 4 (as shown in FIG. 3). An arm portion 41 is extended from the swing base 4 for rotatably mounting the swing base 4 on a post axis 14 in the housing 1. Thus, the flywheel 22 is adjacent to opposite end sides of the sliding base 3 and the roller 90.

Figure 11:
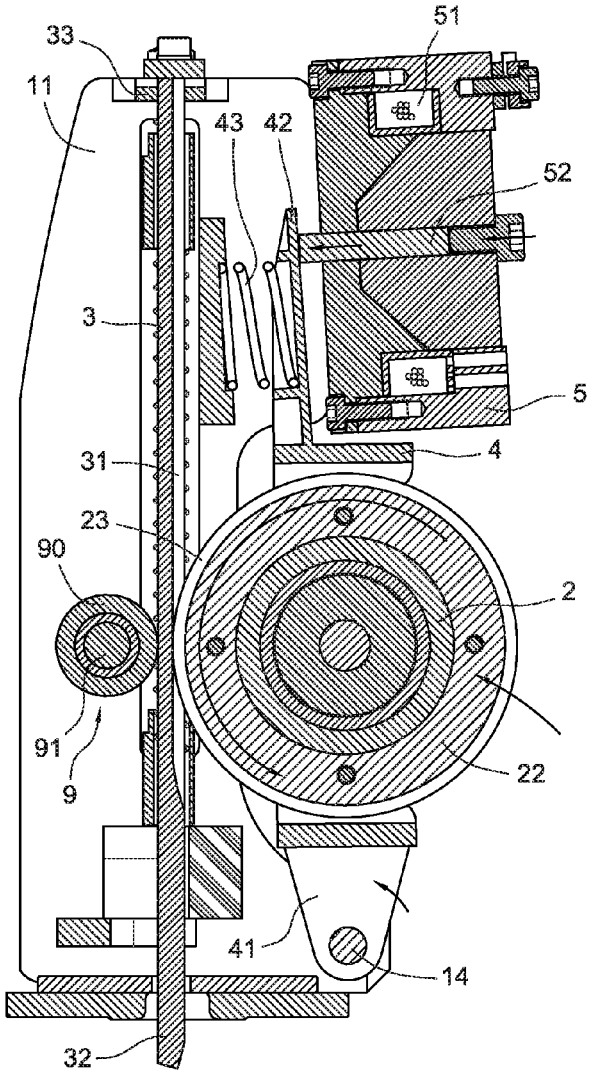
Figure 12:
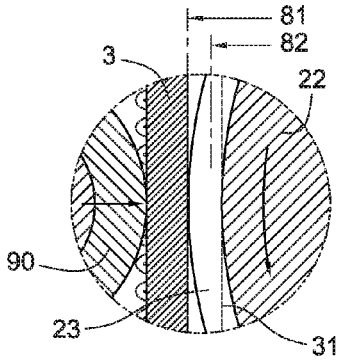
Figure 13:
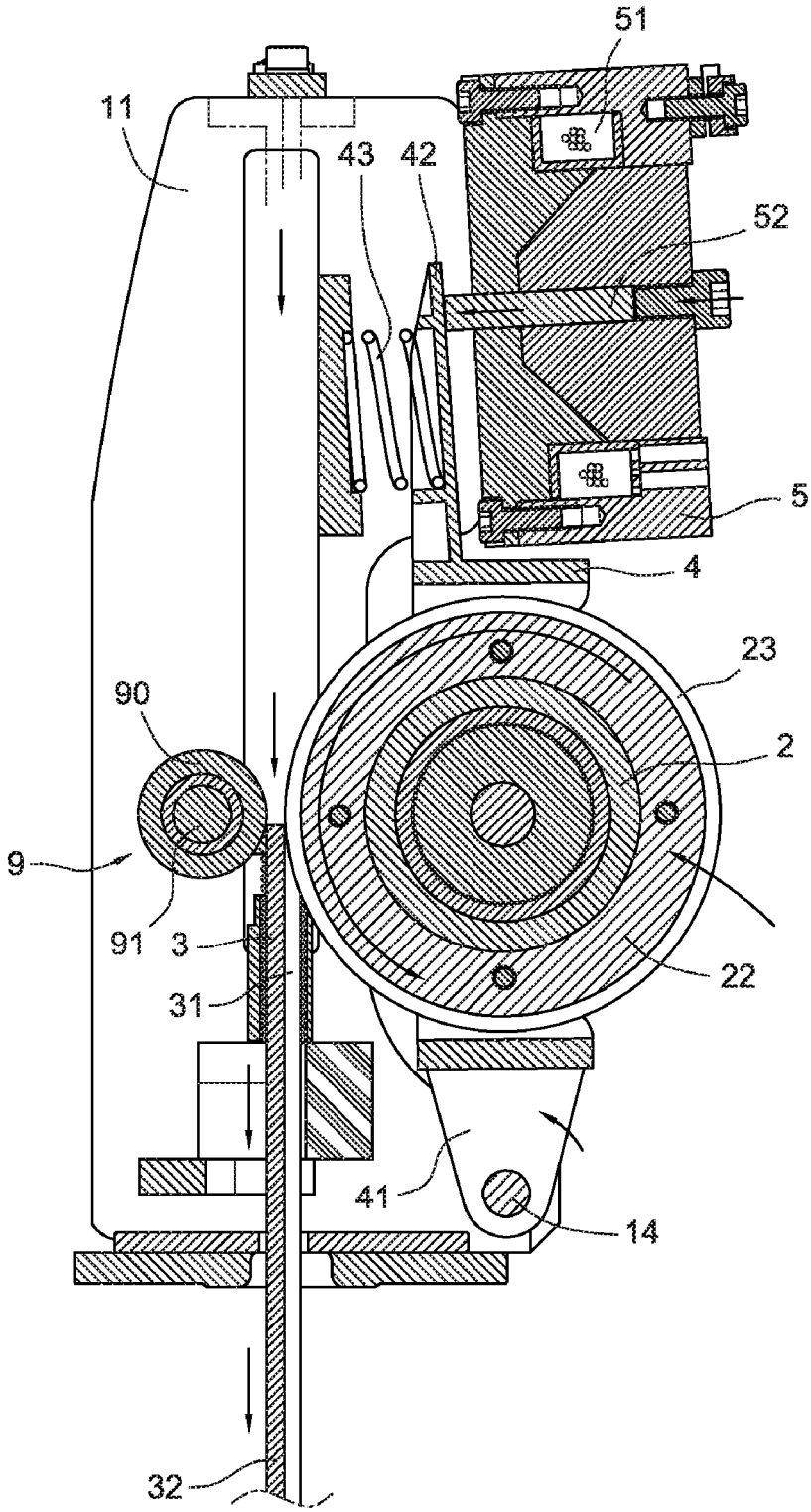

The electric driver 5 may be substantially a solenoid valve which has a rod member 52 driven by a solenoid coil 51, or the like activated by electricity (for example, a pushing device including a worm which is driven by a motor to thereby causing a reciprocating movement of the worm). The electric driver 5 is securely attached to a position where adjacent to an end side of the swing base 4. The solenoid coil 51 is activated or demagnetized by switching on the first switch 16 or the second switch 17. When the solenoid coil 51 is activated, the swing base 4 is driven to rotate to a first position 81 (as shown in FIG. 11 to FIG. 13) in which the flywheel 22 can mesh with the sliding base 3 to cause a downward movement of the sliding base 3, and when the solenoid coil 51 is demagnetized, the swing base 4 is rotated to a second position 82 (as shown in FIG. 8 and FIG. 9) in which the flywheel 22 is disengaged from the sliding base 3 to cause an upward movement of the sliding base 3 due to elastic recovery of the compressible spring 6.

In further details, an extension plate 42, extending out from the swing base 4, is pushed by the rod member 52. Thereby, the swing base 4 is driven from the second position 82 to the first position 81. Alternatively, the rod member 52 may drive another portion of the swing base 4 to pivot the swing base 4 about the post axis 14, thereby causing a movement of the swing base 4 from the second position 82 to the first position 81.

Figure 8:
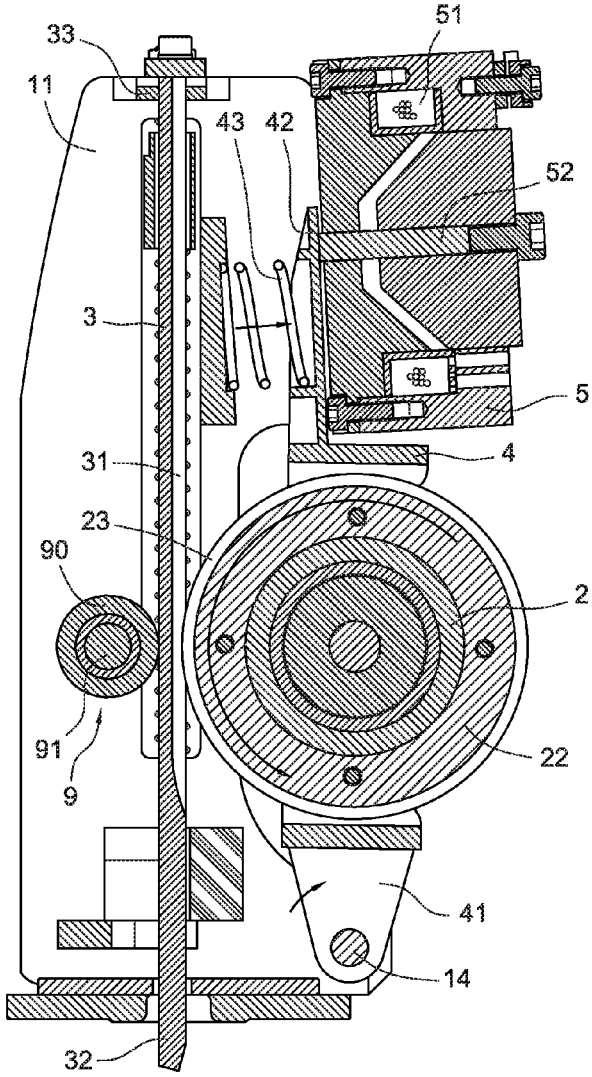
Figure 9:
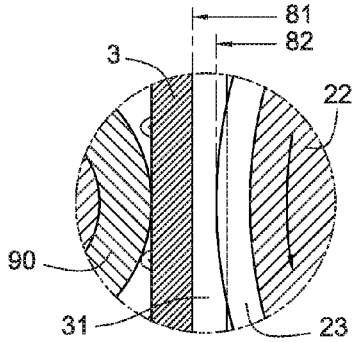

Furthermore, when the electric driver 5 is a solenoid valve, an elastic member 43 may be arranged between the extension plate 42 and the supporting bracket 11 to push against the swing base 4 to swing from the first position 81 to the second position 82 (as shown in FIG. 8). The elastic member 43 may be substantially a compressible spring or the like.

According to the aforementioned structure, two hitting operation modes, such as a sequential actuation mode and a contact actuation mode, are described in detail as follows.

Figure 7:
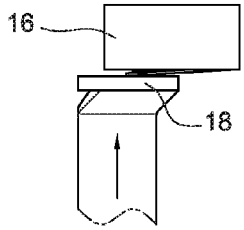
FIG. 7 to FIG. 13 are cross-sectional view of the preferred embodiment of the invention during starting a hitting nail operation.
Figure 10:
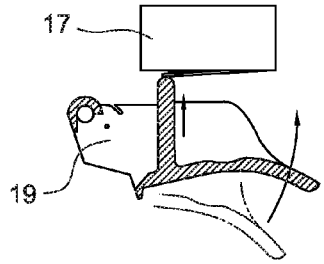

When the sequential actuation mode is executed, the safety sliding rod 18 is first pushed against the work piece. The first switch 16 (as shown in FIG. 3 and FIG. 7) is then switched on to cause the motor 2 to rotate, thereby driving the flywheel 22 to rotate (as shown in FIG. 8). At the moment, the flywheel 22 remains in the second position 82 (as shown in FIG. 9) in disengagement with the sliding base 3. Subsequently, the trigger 19 can be pulled to switch on the second switch 17 (as shown in FIG. 10). Thus, the electric driver 5 is activated by the battery pack 10 to cause a traverse extension of the rod member 52 (as shown in FIG. 11), thereby driving the swing base 4 to rotate to the first position (as shown in FIG. 12). When the flywheel 22 exerts a force on the sliding base 3 and stably meshes with the sliding base 3, the sliding base downwardly moves to hit a nail after overcoming the compressible spring 6 (shown in FIG. 13). After a hitting nail operation is finished, the motor 2 and the electric driver 5 are automatically switched off so that the swing base 4 is driven by the elastic member 43 to rotate from the first position 81 to the second position 82 (as shown in FIG. 8), thereby disengaging the flywheel 22 from the sliding base 3. The sliding base 3 returns to an original position due to recovery of the compressible spring 6. A single sequential actuation is thus finished as the user releases the safety sliding rod 18 and the trigger 19. If a next operation needs to be performed, the user may repeat the above-mentioned sequential actuation. Consequently, it is a safety design for avoiding a mis-operation.

When the contact actuation mode is executed, the user may selectively push the safety sliding rod 18 against the work piece or pull the trigger 19 to switch on the first switch 16 (as shown in FIG. 7) or the second switch 17 (as shown in FIG. 10) at first, so that the motor 2 is activated by the battery pack 10 to drives the flywheel 22 to rotate (as shown in FIG. 8). When the safety sliding rod 18 is first pushed against the work piece by the user to urge the flywheel 22 to rotate (as shown in FIG. 7 and FIG. 8). The user pulls the trigger 19 (as shown in FIG. 10) to switch on the second switch 17 to operate the abovementioned sequential actuation mode. The difference lies in: after a single hitting nail operation is finished, the user may only release the safety sliding rod 18 and not release the trigger 19, or only release the trigger 19 and not release the safety sliding rod 18, if the safety sliding rod 18 is pushed again or the trigger 19 is pulled again, a second hitting nail operation can be thus started. When the user first pulls the trigger 19 to switch on the second switch 17 to cause rotation of the flywheel 22 (as shown in FIGS. 8 and 10). Subsequently, the safety sliding rod 18 is pushed by the user to switch on the first switch 16 (as shown in FIG. 7), thereby urging extension of the rod member 52 of the electric driver 5 (as shown in FIG. 11). The transmission of kinetic energy and hitting nail operation is the same to the aforementioned operation. It is a contact actuation mode which is advantageous to a continuous hitting nail operation.

To sum up, in the preferred embodiment of the present invention, the flywheel 22 is mounted on the outer wall of the external-running DC brushless motor 2. The flywheel 22 is directly driven by the motor 2 to rotate; thereby the configuration for the actuator of the flywheel 22 is simplified. It is useful for the miniaturization of the electrical nail gun and improving the operation stability of the driver of the flywheel 22. The preferred embodiment of the present invention has sufficiently disclosed necessary technical features which can be employed in industry. The flywheel 22 directly meshes with the sliding base 3 to thereby driving the hitting nail bar 32 on the sliding base 3 to move downwards to hit the nail, it is an advantageous to improve durability of the electrical nail gun. In addition, the supporter 9 is positioned in the housing 1. When the flywheel 22 rotates to the first position 81 to cause engagement of the flywheel 22 with the sliding base 3, the pushing force exerts on the sliding base 3 by the flywheel 22 is fully counteracted by the supporter 9. Thus, the sliding base 3 can be stably engaged with the flywheel 22 to generate a positive linear force along a nail hitting direction to hit nail. It is an advantageous to improve operation stability and durability of the electrical nail gun.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An actuator arranged in a housing of an electrical nail gun, comprising:

a sliding base slidably disposed on an end of a located supporter positioned in the housing, the sliding base loading a spring and forming a hitting nail bar thereon;

an external-running direct current motor having a stator and a rotator attached on an outer wall of the stator, a flywheel driven by the motor, and the flywheel being configured to engage or disengage with/from the sliding base;

a swing base pivotally mounted on the housing, the swing base being adjacent to the sliding base and the supporter, the motor installed in the swing base; and an electric driver attached to the housing and being adjacent to an end side of the swing base, the electric driver having a rod member driven by electricity, wherein the rod member drives the swing base to swing to a first position where the flywheel meshes with the sliding base to thereby drive the sliding base to move downwards, and a second position where the flywheel disengages from the sliding base to thereby cause the sliding base to reposit.

2. The actuator as claimed in claim 1, wherein the sliding base is fixedly mounted on a sliding plate, the sliding plate is slidably attached to a guiding pole which is positioned in the housing, and a compressible spring is wrapped around the guiding pole for pushing the sliding plate as the spring is compressed.

3. The actuator as claimed in claim 1, wherein the stator of the motor has a shaft which is disposed on the swing base, the rotator has a sleeve barrel which is attached around the shaft, and the flywheel is mounted to an outer side of the sleeve barrel.

4. The actuator as claimed in claim 1, wherein a side surface of the sliding base defines a plurality of linear grooves therein, and the flywheel defines a plurality of ring-shaped or sector-shaped grooves therein for mesh with the linear grooves of the sliding base.

5. The actuator as claimed in claim 1, wherein the swing base is rotatably mounted on a post axis in the housing, and the flywheel is adjacent to end sides of the sliding base and the supporter.

6. The actuator as claimed in claim 1, wherein the swing base is formed to have an arm portion thereon.

7. The actuator as claimed in claim 1, wherein the electric driver is a solenoid valve.

8. The actuator as claimed in claim 1, wherein an extension plate extends out from the swing base, and the rod member pushes the extension plate to thereby drive the swing base to swing from the second position to the first position.

9. The actuator as claimed in claim 8, wherein an elastic member is disposed between the extension plate and an end wall of the housing for driving the swing base to swing from the first position to the second position.

10. The actuator as claimed in claim 1, wherein the external-running direct current motor is a brushless DC motor.

* * * * *